US008460499B2

(12) United States Patent
Stenner et al.

(10) Patent No.: US 8,460,499 B2
(45) Date of Patent: Jun. 11, 2013

(54) DEVICE FOR DISPENSING LABELS, SUCH AS SELF-ADHESIVE LABELS, ON OBJECTS

(75) Inventors: Holger Stenner, Haltern am See (DE); Frank Putzer, Hamburg (DE)

(73) Assignee: KHS GmbH, Dortmund (DE)

( * ) Notice: Subject to any disclaimer, the term of this patent is extended or adjusted under 35 U.S.C. 154(b) by 152 days.

(21) Appl. No.: 12/257,795

(22) Filed: Oct. 24, 2008

(65) Prior Publication Data

US 2009/0126866 A1 May 21, 2009

Related U.S. Application Data

(63) Continuation-in-part of application No. PCT/EP2007/002754, filed on Mar. 28, 2007.

(30) Foreign Application Priority Data

Apr. 26, 2006 (DE) ..... 10 2006 019 265

(51) Int. Cl.
*B44C 3/02* (2006.01)

(52) U.S. Cl.
USPC ..... 156/235; 156/363; 156/378; 156/538; 156/238; 156/239; 156/249; 156/64; 156/229; 156/494; 156/566

(58) Field of Classification Search
USPC ..... 156/363, 378, 538, 238, 239, 249, 156/64, 229, 361, 494–496, 542, 566, 567
See application file for complete search history.

(56) References Cited

U.S. PATENT DOCUMENTS

| | | | | |
|---|---|---|---|---|
| 4,276,112 | A | 6/1981 | French et al. | |
| 4,366,023 | A | 12/1982 | Voltmer | |
| 5,248,355 | A | 9/1993 | Olsen | |
| 5,902,449 | A * | 5/1999 | Moore | 156/541 |
| 5,938,890 | A | 8/1999 | Schlinkmann | |
| 6,352,094 | B1 | 3/2002 | Gunderson | |

FOREIGN PATENT DOCUMENTS

| | | |
|---|---|---|
| CH | 691 231 | 5/2001 |
| DE | 26 44 462 | 8/1977 |
| DE | 30 15 281 | 10/1981 |
| DE | 37 02 595 | 8/1988 |
| DE | 40 02 194 | 8/1991 |
| DE | 195 22 295 | 1/1997 |
| DE | 199 20 736 | 3/2000 |
| DE | 20 2005 005713 | 6/2005 |
| FR | 2 737 185 | 1/1997 |
| JP | 2006 076587 | 3/2006 |

OTHER PUBLICATIONS

International Search Report PCT/EP2007/002754 and English translation thereof.

* cited by examiner

*Primary Examiner* — Khanh Nguyen
*Assistant Examiner* — Margaret Squalls
(74) *Attorney, Agent, or Firm* — Nils H. Ljungman & Associates

(57) ABSTRACT

A labeling machine for the dispensing of labels, such as self-adhesive labels, on objects, such as containers or bottles. The labeling machine has an arrangement for the generation of a defined strip tension of the labeling material over its strip length between a looper and a dispensing edge, and for the generation of a defined strip tension of the backing material over at least a part of its strip length between the dispensing edge and a receptacle for the backing material.

18 Claims, 4 Drawing Sheets

DEVICE FOR DISPENSING LABELS, SUCH AS SELF-ADHESIVE LABELS, ON OBJECTS

CONTINUING APPLICATION DATA

This application is a Continuation-In-Part application of International Patent Application No. PCT/EP2007/002754, filed on Mar. 28, 2007, which claims priority from Federal Republic of Germany Patent Application No. 10 2006 019 265.6, filed on Apr. 26, 2006. International Patent Application No. PCT/EP2007/002754 was pending as of the filing date of this application. The United States was an elected state in International Patent Application No. PCT/EP2007/002754.

BACKGROUND

1. Technical Field

This present application relates to a device for dispensing labels, such as self-adhesive labels, on objects.

2. Background Information

Background information is for informational purposes only and does not necessarily admit that subsequently mentioned information and publications are prior art.

Devices or labeling units on then, which labeling objects with self-adhesive labels, which are pulled at a removal or dispensing edge from a strip-format backing material (backing film) that serves as a backing for the labels by bending this material around the dispensing edge and are transferred to the individual object to be labeled.

In these devices, for the movement of the backing material over the dispensing edge and thus for the removal of the labels from the backing material, there is a first automatic advance unit which is driven intermittently or in a clocked manner by a drive mechanism so that, for example, in each work cycle, a label can be applied to an object that is being moved past the dispensing edge. An additional automatic feed unit is used for the continuous extraction of the label material consisting of the labels and the backing material from a supply roll, and for the transport of this label material into a loop well of a looper which is provided in the direction of transport between this additional automatic feed unit and the dispensing edge, to achieve a matching between the continuous removal of the label material from the supply roll and the clocked advance movement of the label material or of the backing material across the dispensing edge. The looper forms, from the label material in the loop well, without guide rollers and using only or usually a current of air or gas, a "mass-less" or "approximately mass-less" loop, so that sufficient label material is always or virtually always available for the intermittent advance movement of the label material or for the start-stop operation of the automatic feed unit that moves the label material across the dispensing edge. An additional drive mechanism is provided for a receptacle or a winding mandrel for an empty spool, onto which the empty backing material, i.e. the backing material from which the labels have been removed, is wound up.

One disadvantage of these known devices is that, possibly with thin backing material, the backing material can flutter or run untrue, e.g., an oscillating, deviation of the label or backing material can occur in the direction transverse to the longitudinal direction of the labeling material or in the lengthwise direction of the strip of labeling or backing material between the looper and the dispensing edge and/or in the direction transverse to the longitudinal direction of the labeling material or in the lengthwise direction of the strip after the dispensing edge and before the winding mandrel that holds the empty coil, which results in the generation of noise and/or production disruptions caused by a tearing of the backing material. Possibly to restrict or minimize disruptions in production, in the prior art thicknesses in the range between twenty and twenty-five micrometers are customary for the backing material. Label materials with thinner backing materials, for example in the range of fifteen micrometers, which would be advantageous in terms of a savings in the costs of material and/or disposal and to increase the number of labels per supply roller, cannot be reliably processed using these devices.

OBJECT OR OBJECTS

The term "object" as used within the meaning of this present application means the widest possible variety of objects and/or products which are provided with one or more labels, including but not limited to containers such as bottles, cans, bundles, etc., for example.

The object of the present application is to create a device with which the disadvantages described above can be overcome.

SUMMARY

To accomplish this object, the present application teaches a device for the dispensing of labels, possibly self-adhesive labels, on objects, in which the dispensing commences by pulling the labels off a strip-format backing material of a labeling material at a dispensing edge, with a first automatic feed unit for the clocked advance of the labeling material which is fed from a supply via a looper to the dispensing edge. The device also comprises means for the generation of a defined strip tension of the labeling material over its strip length between the looper and the dispensing edge and/or for the generation of a defined strip tension of the backing material over at least a part of its strip length adjacent to the dispensing edge between the dispensing edge and a receptacle for the empty backing material. Developments of the present application are further disclosed according to the present application.

A fluttering or flapping of the label material and/or of the backing material is effectively restricted or minimized as a result of the application of pressure to the strip-format label material on its strip length between the looper and the dispenser edge and/or of the strip-format backing materials at least in a subsection of the strip length that is downstream of the dispensing edge between the dispensing edge and the winding mandrel with an additional strip tensioner.

In at least one possible embodiment of the present application, at least one labeling device is used in a labeling station of a beverage bottling plant.

In at least one possible embodiment of the present application, at least one labeling device is used for labeling plastic bottles or containers with wraparound labels.

The above-discussed embodiments of the present invention will be described further herein below. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

Developments of the presence application are disclosed according to the present application. The present application is described in greater detail below with reference to the accompanying figure.

DESCRIPTION OF EMBODIMENT OR EMBODIMENTS

Figure 1:
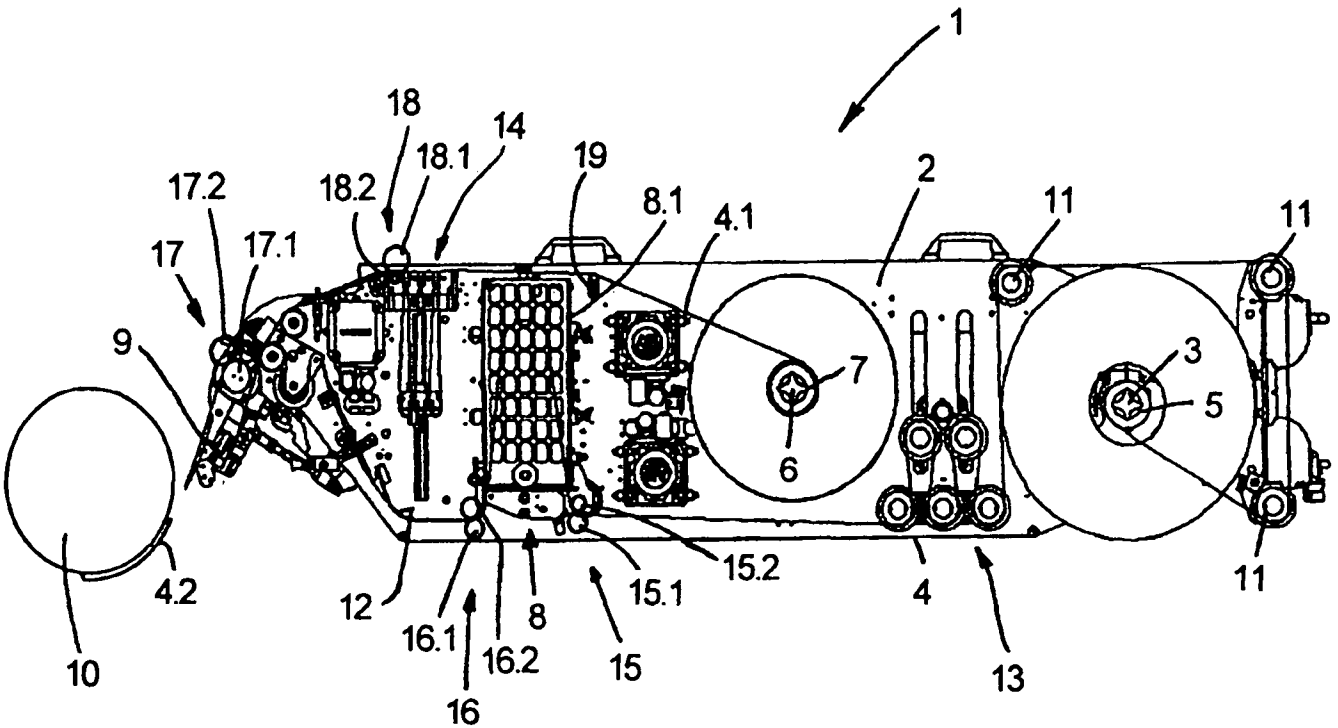
FIG. 1 which shows a plan view of a labeling unit for the processing of self-adhesive labels.

The labeling unit designated 1 in the accompanying FIG. 1 comprises, among other things, a flat housing or support 2, on the top of which there are various functional elements of the labeling unit 1, namely, among others:

- a winding mandrel or a receptacle 3 for a supply of labeling material 4 in the form of a supply roll 5, from which, during the labeling process, the labeling material 4 consisting of the strip-format backing material 4.1 and the self-adhesive labels 4.2 is extracted;
- a receptacle or a winding mandrel 6 for winding up the empty backing material 4.1 from which the labels 4.2 have been removed on an empty spool 7;
- a looper 8 for the formation of an approximately "massless" loop of the label material 4 in a loop well 8.1;
- a dispensing edge 9, across which the labeling material 4 is guided with a deflection at an angle of almost one hundred-eighty degrees, and in one possible embodiment for the discharge of the self-adhesive labels 4.2 onto the objects 10, such as bottles or similar containers, as they are moved past this dispensing edge.

Also provided on the support 1, in addition to various deflector rollers 11 and guides 12, there are buffer rollers 13 and 14, which are described in greater detail below, as well as automatic feed units 15, 16, 17 for the label material 4 and/or for the backing material 4.1.

In the illustrated embodiment, the labeling material 4 is guided from the supply roll 5 via three deflector pulleys 11, via the buffer rollers 13 to maintain a specified strip tension, via the automatic feed unit 15 for the extraction of the label material 4 from the roll 5 and for the transport of the label material 4 into the looper 8, through the looper 8, through the automatic feed unit 16 and a plurality of deflector pulleys 1 to the dispensing edge 9. In the illustrated embodiment, the empty backing material 4.1 is guided from the dispensing edge 9 through the automatic advance unit 17 and via a plurality of deflector pulleys to the automatic feed unit 18, and from there via the buffer roller 14 or its rollers to the receptacle 6 and the empty spool 7 located there which winds up the backing material 4.1 which is no longer needed or desired.

The automatic feed units 15 through 18 each comprise a driven roller 15.1, 16.1, 17.1 and 18.1 respectively and of a freely rotating mating roller 15.2, 16.2, 17.2 and 18.2 respectively. The labeling material 4 and/or the backing material 4.1 are each guided between the two rollers of the corresponding automatic feed unit 15 through 18.

For the discharge of the labels 4.2 onto the objects 10 that are being moved past the dispensing edge 9, a clocked extraction of the backing material 4.1 from the dispensing edge 9 is desired, so that the automatic feed unit 17 and/or the driven roller 17.1 of this device is driven by the associated clocked drive.

With the automatic feed unit 15, the labeling material 4 is continuously extracted from the supply or the roll 5. For this purpose the automatic feed unit 15 is driven continuously, and specifically so that the required or desired length of the backing material 4.1 transported during the work cycle of the clocked driven automatic feed unit 17 equals the length of labeling material 4 extracted by the transport device 15 from the roll 5 during the same period of time.

The receptacle 6 is driven in a controlled manner by means of a sensor 19 that measures the tension of the backing material 4.1 so that during the operation of the labeling unit 1 with the receptacle 6, a length of backing material 4.1 is always or virtually always wound up such that this carrier material has a specified strip tension over the length of the material or the strip length between the buffer roller 14 and the receptacle 6, and so that the backing material 4.1 is therefore wound up on the spool body 7 without any untrue running, flapping or fluttering of the backing material 4.1 on the strip length between the buffer roller 14 and the receptacle 6.

The automatic feed units 16 and 18 are driven in synchronization with the automatic feed unit 17 and are in one possible embodiment also clocked so that the transport speed of the automatic feed unit 16 is less by an amount x than the transport speed n of the automatic feed unit 17, i.e. the transport speed of the automatic feed unit 16 is n−x. The automatic feed unit 18 is realized so that its transport speed is greater by an amount y than the transport speed n of the automatic feed unit 17, i.e. the transport speed of the automatic feed unit 18 is n+y. Both automatic feed units 16 and 18 are also realized so that the labeling material 4 or the backing material 4.1 is guided with some slip between the rollers 16.1 and 16.2 or 18.1 and 18.2 respectively.

In other words, and in accordance with at least one possible embodiment of the present application, each successive driven roller is rotated at a speed that is higher or faster than the previous driven roller. For example, driven roller 15.1 of the automatic feed unit 15 is driven at a continuous speed. The driven roller 17.1 of the clocked automatic feed unit 17, driven with a speed n, has an output that is similar to the output of the driven roller 15.1 of the automatic feed unit 15. The driven roller 16.1 of the clocked automatic feed unit 16, which is disposed between the automatic feed unit 15 and the automatic feed unit 17, is rotated at a speed that is slower than that of the driven roller 17.1. The driven roller 18.1 of the automatic feed unit 18, which is disposed downstream from the automatic feed unit 17 for the feed of backing material 4.1, is rotated at a speed that is faster than that of the driven roller 17.1. By configuring each successive driven roller to be rotated at a speed that is higher or faster than the previous driven roller, an optimum strip tension is essentially promoted. The clocked automatic feed unit 16, however, is driven at a speed that is slower than the continual automatic feed unit 15. The slack in the strip label material 4, caused by the difference in the speeds between the automatic feed units 15 and 16, is fed through the looper 8, which is configured to maintain a taut loop of label material 4 with adequate strip tension. The arrangement of the automatic feed units 15, 16, 17, and 18 and the looper 8 promotes an optimum feeding of labeling material 4 and/or backing material 4.1 without disruption and with optimum strip tension.

Because the transport speeds of the automatic feed units 16 and 18 differ from the transport or advance speed of the automatic feed unit 17, it is essentially guaranteed or promoted that the labeling material 4 and/or the backing material 4.1 has the most constant possible strip tension on the strip length between the automatic feed unit 16 and the dispensing edge 9 and/or on the strip length between the dispensing edge 9 and the automatic feed unit 18, and therefore in these areas, in spite of the clocked advance by the automatic feed unit 17 there is no untrue running, fluttering or flapping of the labeling material 4 and/or of the backing material 4.1 and any noise or production problems that might be caused by the tearing of the backing material 4.1 can be restricted or minimized.

In one possible embodiment of the present application, any fluttering or flapping of the labeling material 4 and/or the backing material 4.1 can be detected with the use of an optical vibration sensor, for example, possibly either a motion detector or a camera.

Figure 2:
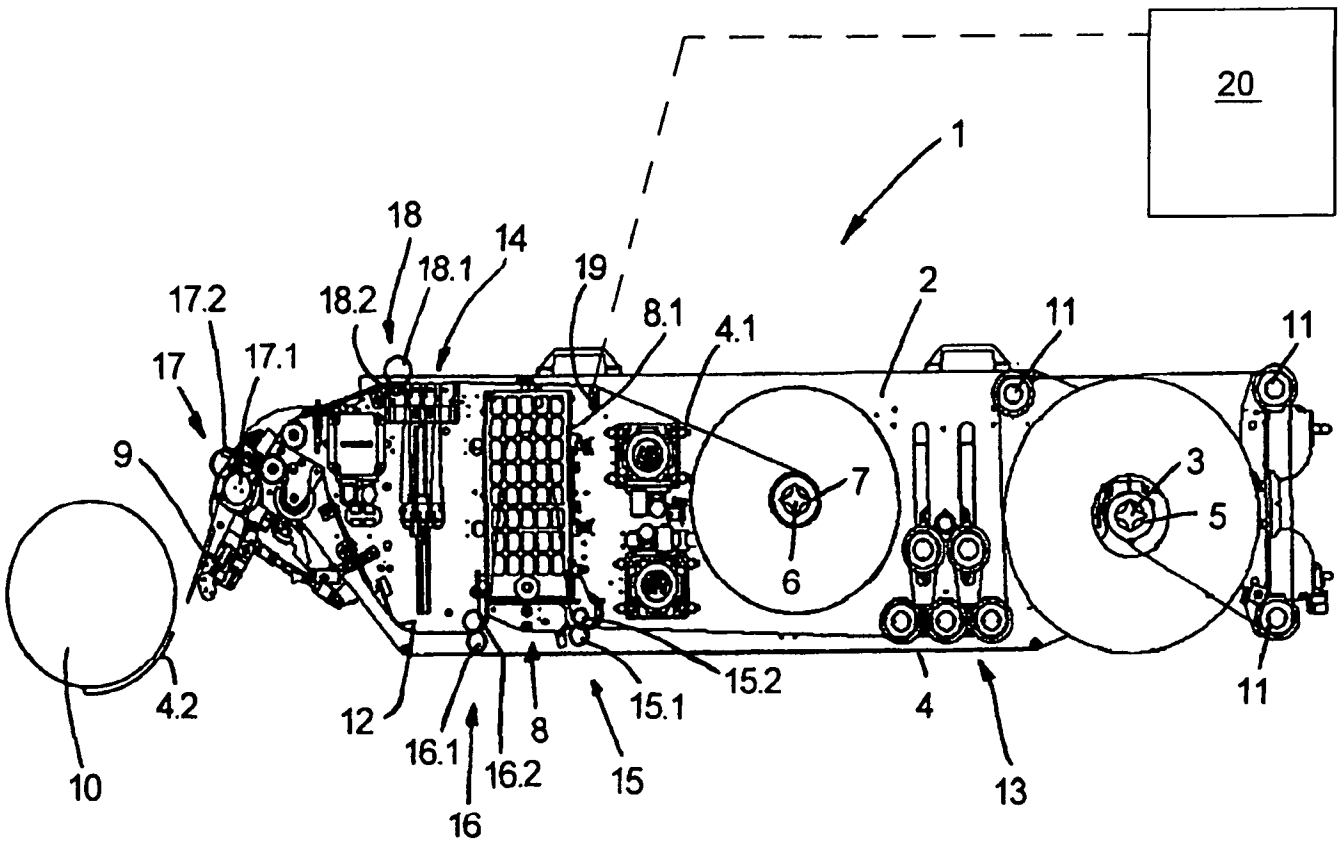
FIG. 2 shows a plan view of a labeling unit similar to that of FIG. 1, including a memory.

In at least one possible embodiment of the present application, optimal tension of the label material 4 and/or the backing material 4.1 in the labeling unit 1 may be determined experimentally depending on various components of a label material for, such as label material thickness, label material composition, etc. A memory 20, as illustrated in FIG. 2, may be used to store information regarding optimal tension of the label material 4 and/or the backing material 4.1, so that upon changing supply rolls 5 of label material 4, the labeling unit 1 may not need to be adjusted to once again reach optimal tension.

In another possible embodiment of the present application, the memory 20 may be configured to store several sets of conditions for optimal tension of the label material 4 and/or the backing material 4.1, so that upon changing the supply roll 5 to a supply roll 5 of a differing label material 4, the labeling unit 1 may not need to be adjusted to once again reach optimal tension.

Figure 3:
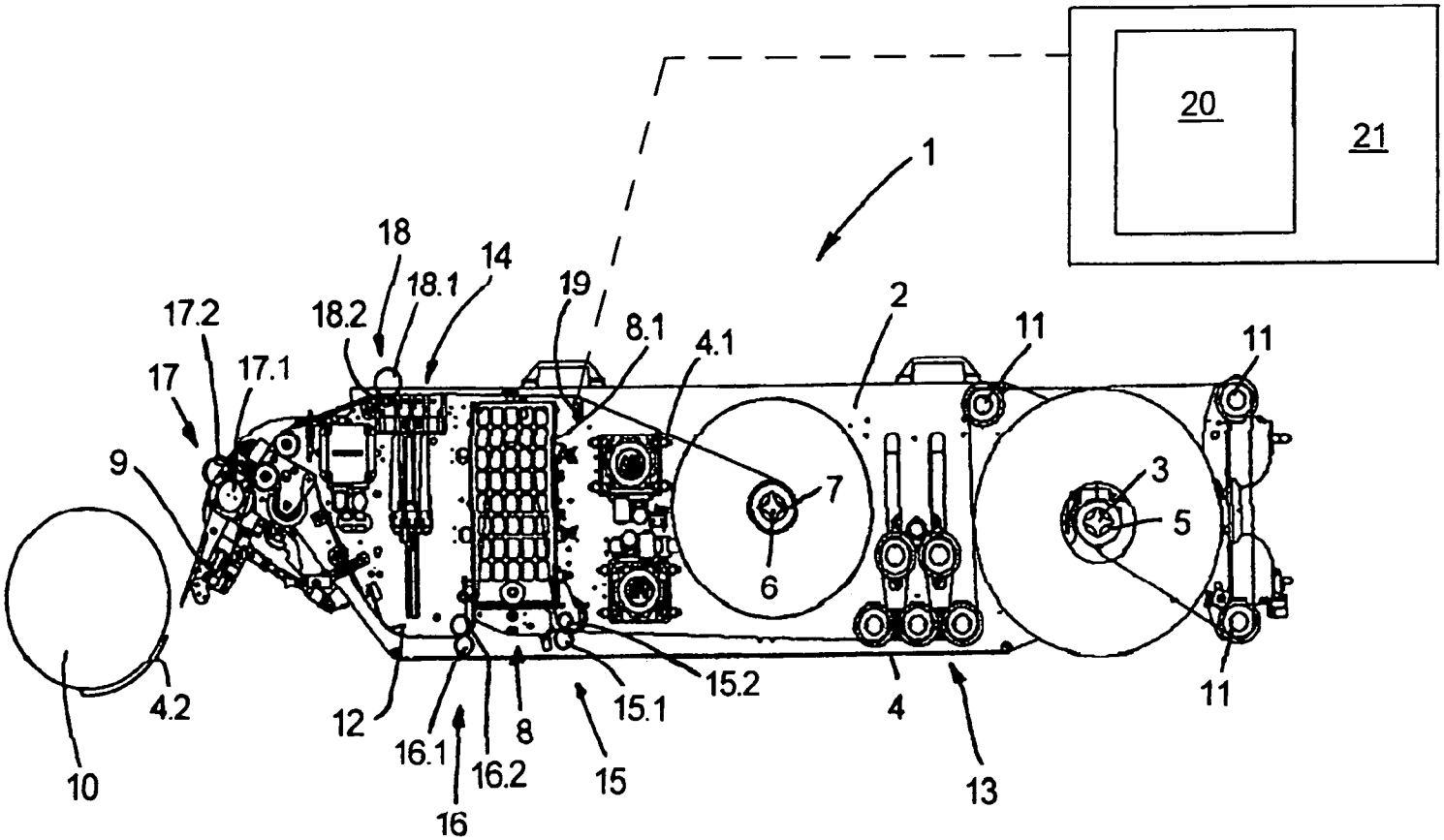
FIG. 3 shows a plan view of a labeling unit similar to that FIG. 2, including the memory and a control system.

In one possible embodiment of the present application, as can be seen in FIG. 3, the labeling unit 1 also comprises a control system 21. The control system 21, which includes the memory 20, is configured to receive information from the memory 20, and is also configured to send signals to adjust the rotational speed of the automatic feed units 15, 16, 17, and 18. In another possible embodiment, the control system 21 may also be configured to be programmed manually, and the automatic feed units 15, 16, 17, and 18 can also be programmed manually. Because the automatic feed units 15, 16, 17, and 18 can be programmed, adjustments can be made in order for the labeling unit 1 to handle different types of labeling material 4 and/or backing material 4.1, such as types that differ in terms of thickness, width, etc.

The different advance speeds of the automatic feed units 16, 17 and 18 can be realized, for example, by having these automatic feed units and/or their rollers 16.1, 17.1, and 18.1 respectively driven by a common intermittent or clocked drive, but by means of drive trains with different translation ratios, and/or are realized so that the driven rollers 16.1, 17.1, and 18.1 have different diameters that correspond to the different advance speeds.

In the illustrated embodiment, the automatic feed unit 16 is located directly at the outlet of the looper 8 and/or of the loop well 8.1, whereby in that case a roller of the automatic feed unit 16, such as the counter roller 16.2, for example, is formed by a deflector pulley or roller which is desired at this outlet anyway.

The automatic feed unit 18 is provided directly at the inlet of the buffer roller 14 (jockey roller or looping roller). A roll or roller of this automatic feed unit, such as the mating roller 18.2, for example, is thereby possibly the roll that is present anyway immediately or substantially immediately at the inlet of this buffer roller.

In the illustrated embodiment, the looper 8 is also used for the equalization between the continuous advance movement of the labeling material 4 on the strip length between the supply roll 5 and the automatic feed unit 15 and the clocked advance movement of the labeling material 4 on the strip length between the automatic feed unit 16 and the dispensing edge 9, and is realized so that in its loop well 8.1, the loop of the labeling material 4 is formed without the use of deflector rollers, e.g. by a gaseous medium, e.g. by compressed air, that flows through the loop well.

As a result of the use of the automatic feed units 15 through 18 it is also possible to transport the labeling material 4 backward, i.e. opposite to the direction of advance desired during the processing of the labels 4.2. As a result, it is possible in a simple manner, after a supply roll 5 has been used up, to connect the end of the labeling material 4 with the beginning of the labeling material 4 of a new roll which is placed on the receptacle 3 or on the winding mandrel located there.

In other words, and in accordance with at least one possible embodiment of the present application, the forward momentum of the labeling material 4 and/or the backing material 4.1 can be paused or reversed. When a supply 5 runs low or is emptied of the labeling material 4, the end of an old supply roll 5 can be glued or otherwise attached to a beginning of a new, full supply roll 5, such that there is no interruption in the feeding of labeling material 4 and/or backing material 4.1.

The present application was explained above on the basis of one possible embodiment. It goes without saying that modifications and variations are possible without thereby going beyond the teaching of the present application.

In the above description it was assumed that the labeling material 4 as well as the backing material 4.1 are each guided with slip by the automatic feed units 16 and 18 respectively. Basically, it is also possible to provide regulated drives for these automatic feed units so that these automatic feed units and/or their drive mechanisms are driven, with the use of sensors that measure or determine the strip tension, so that the desired strip tension is achieved, e.g., the strip tension desired to restrict or minimize fluttering or flapping.

It is also possible, on one or more automatic feed units 15 through 18, to drive the two rolls or rollers 15.1 through 18.1 and 15.2 through 18.2 respectively in opposite directions to each other.

The sensors that measure or determine the strip tension can, for example, be a movable roll that is in contact with the labeling material 4 and is displaced by a specified distance from its normal position as a function of the current strip tension.

Figure 1A:
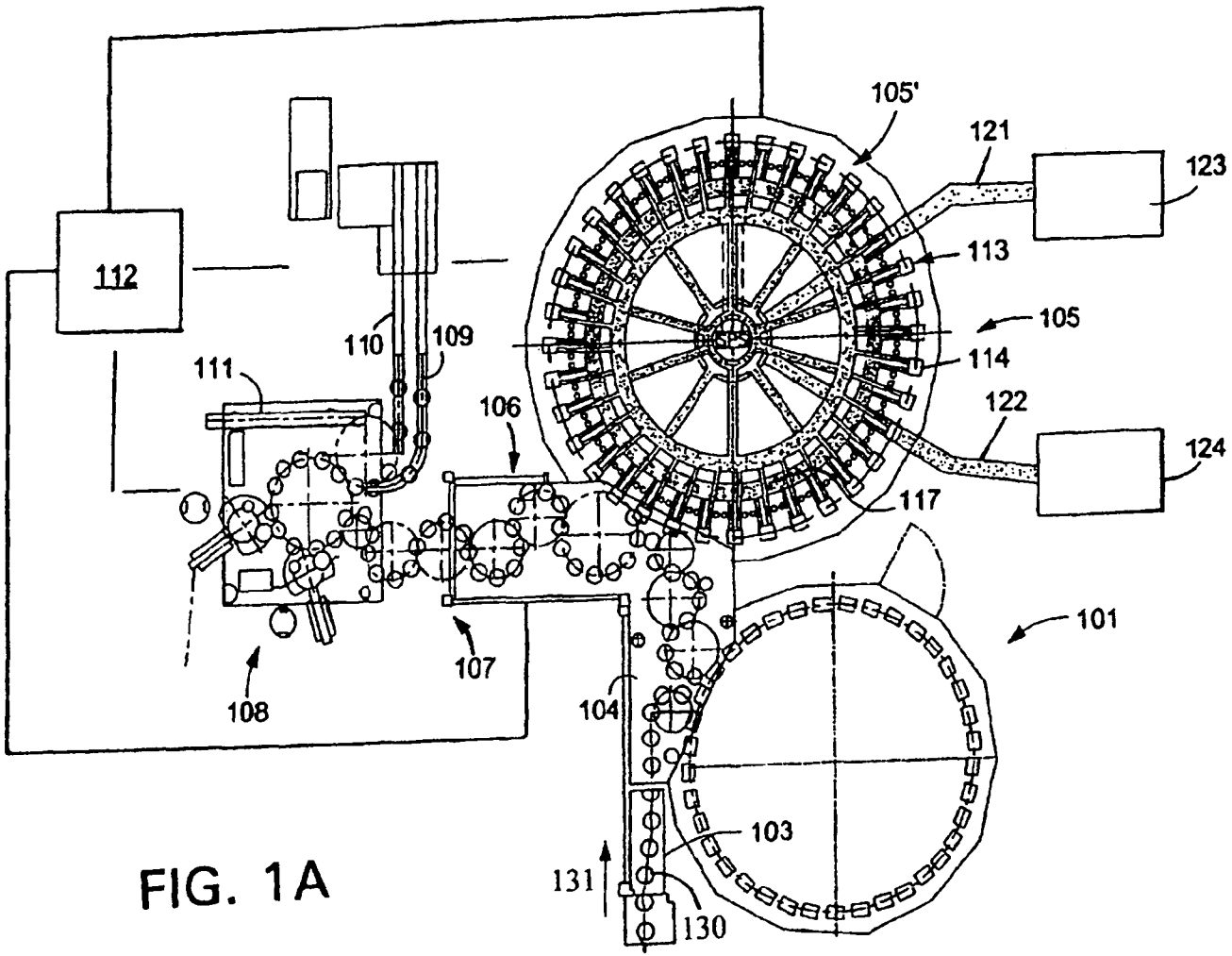
FIG. 1A shows schematically the main components of one possible embodiment example of a system for filling containers.

FIG. 1A shows schematically the main components of one possible embodiment example of a system for filling containers, specifically, a beverage bottling plant for filling bottles 130 with at least one liquid beverage, in accordance with at least one possible embodiment, in which system or plant could possibly be utilized at least one aspect, or several aspects, of the embodiments disclosed herein.

FIG. 1A shows a rinsing arrangement or rinsing station 101, to which the containers, namely bottles 130, are fed in the direction of travel as indicated by the arrow 131, by a first conveyer arrangement 103, which can be a linear conveyor or a combination of a linear conveyor and a starwheel. Downstream of the rinsing arrangement or rinsing station 101, in the direction of travel as indicated by the arrow 131, the rinsed bottles 130 are transported to a beverage filling machine 105 by a second conveyer arrangement 104 that is formed, for example, by one or more starwheels that introduce bottles 130 into the beverage filling machine 105.

The beverage filling machine 105 shown is of a revolving or rotary design, with a rotor 105', which revolves around a central, vertical machine axis. The rotor 105' is designed to receive and hold the bottles 130 for filling at a plurality of filling positions 113 located about the periphery of the rotor 105'. At each of the filling positions 103 is located a filling arrangement 114 having at least one filling device, element, apparatus, or valve. The filling arrangements 114 are designed to introduce a predetermined volume or amount of liquid beverage into the interior of the bottles 130 to a predetermined or desired level.

The filling arrangements 114 receive the liquid beverage material from a toroidal or annular vessel 117, in which a supply of liquid beverage material is stored under pressure by a gas. The toroidal vessel 117 is a component, for example, of the revolving rotor 105'. The toroidal vessel 117 can be connected by means of a rotary coupling or a coupling that permits rotation. The toroidal vessel 117 is also connected to at least one external reservoir or supply of liquid beverage material by a conduit or supply line. In the embodiment shown in FIG. 1A, there are two external supply reservoirs 123 and 124, each of which is configured to store either the same liquid beverage product or different products. These reservoirs 123, 124 are connected to the toroidal or annular vessel 117 by corresponding supply lines, conduits, or arrangements 121 and 122. The external supply reservoirs 123, 124 could be in the form of simple storage tanks, or in the form of liquid beverage product mixers, in at least one possible embodiment.

As well as the more typical filling machines having one toroidal vessel, it is possible that in at least one possible embodiment there could be a second toroidal or annular vessel which contains a second product. In this case, each filling arrangement 114 could be connected by separate connections to each of the two toroidal vessels and have two individually-controllable fluid or control valves, so that in each bottle 130, the first product or the second product can be filled by means of an appropriate control of the filling product or fluid valves.

Downstream of the beverage filling machine 105, in the direction of travel of the bottles 130, there can be a beverage bottle closing arrangement or closing station 106 which closes or caps the bottles 130. The beverage bottle closing arrangement or closing station 106 can be connected by a third conveyer arrangement 107 to a beverage bottle labeling arrangement or labeling station 108. The third conveyor arrangement may be formed, for example, by a plurality of starwheels, or may also include a linear conveyor device.

In the illustrated embodiment, the beverage bottle labeling arrangement or labeling station 108 has at least one labeling unit, device, or module, for applying labels to bottles 130. In the embodiment shown, the labeling arrangement 108 is connected by a starwheel conveyer structure to three output conveyer arrangements: a first output conveyer arrangement 109, a second output conveyer arrangement 110, and a third output conveyer arrangement 111, all of which convey filled, closed, and labeled bottles 130 to different locations.

The first output conveyer arrangement 109, in the embodiment shown, is designed to convey bottles 130 that are filled with a first type of liquid beverage supplied by, for example, the supply reservoir 123. The second output conveyer arrangement 110, in the embodiment shown, is designed to convey bottles 130 that are filled with a second type of liquid beverage supplied by, for example, the supply reservoir 124. The third output conveyer arrangement 111, in the embodiment shown, is designed to convey incorrectly labeled bottles 130. To further explain, the labeling arrangement 108 can comprise at least one beverage bottle inspection or monitoring device that inspects or monitors the location of labels on the bottles 130 to determine if the labels have been correctly placed or aligned on the bottles 130. The third output conveyer arrangement 111 removes any bottles 130 which have been incorrectly labeled as determined by the inspecting device.

The beverage bottling plant can be controlled by a central control arrangement 112, which could be, for example, computerized control system that monitors and controls the operation of the various stations and mechanisms of the beverage bottling plant.

In one possible embodiment of the present application, the labeling station comprises the labeling unit 1. For example, as illustrated in FIG. 1A, the labeling arrangement 108 comprises at least one labeling unit 1.

The present application relates to a device for the dispensing of labels, possibly self-adhesive labels on objects by removing the labels from a strip-format backing material on a dispensing edge, by which the backing materials is moved at a clocked advance and the labeling material consisting of the labels and the backing material and continuously extracted from a supply are fed via a looper that forms a loop of labeling material.

One feature or aspect of an embodiment is believed at the time of the filing of this patent application to possibly reside broadly in a device for the dispensing of labels 4.2, in one possible embodiment of the present application of self-adhesive labels, on objects 10 by pulling the labels 4.2 off a strip-format backing material 4.1 of a labeling material 4 at a dispensing edge 9, with a first automatic feed unit 17 for the clocked advance of the labeling material 4 which is fed from a supply 3, 5 via a looper 8 to the dispensing edge 9, wherein means 16, 18 for the generation of a defined strip tension of the labeling material 4 over its strip length between the looper 8 and the dispensing edge 9 and/or for the generation of a defined strip tension of the backing material 4.1 over at least a part of its strip length adjacent to the dispensing edge 9 between the dispensing edge 9 and a receptacle 6, 7 for the empty backing material 4.1.

Another feature or aspect of an embodiment is believed at the time of the filing of this patent application to possibly reside broadly in the device, wherein the means 16 for the generation of the defined strip tension are realized so that a constant or essentially constant strip tension is applied the labeling material 4 on its strip length between the looper 8 and the dispensing edge 9.

Yet another feature or aspect of an embodiment is believed at the time of the filing of this patent application to possibly reside broadly in the device, wherein the means 18 for the generation of the defined strip tension is realized so that a constant or essentially constant strip tension is applied the backing material 4.1 at least on its strip length adjacent to the dispensing edge 9.

Still another feature or aspect of an embodiment is believed at the time of the filing of this patent application to possibly reside broadly in the device, wherein the means 18 for the generation of the defined strip tension are formed by at least one additional automatic feed unit 16, 18 for the label and/or backing material 4, 4.1 with an advance or transport speed that differ from the speed of the first automatic feed unit 17.

A further feature or aspect of an embodiment is believed at the time of the filing of this patent application to possibly reside broadly in the device, wherein between the looper 8 and the dispensing edge 9 a second automatic feed unit 16 is provided, which has an advance or transport speed which is lower than that of the first automatic feed unit 17.

Another feature or aspect of an embodiment is believed at the time of the filing of this patent application to possibly reside broadly in the device, wherein in the advance or transport direction of the backing material 4.1, upstream of the receptacle 6, 7 for the empty backing material 4.1, a third automatic feed unit 18 is provided with an advance or transport speed which is greater than that of the first automatic feed unit 17.

Yet another feature or aspect of an embodiment is believed at the time of the filing of this patent application to possibly reside broadly in the device, wherein the first and/or third automatic feed unit 17, 18 which is provided downstream of the dispensing edge 9 in the advance direction of the backing material 4.1.

Still another feature or aspect of an embodiment is believed at the time of the filing of this patent application to possibly reside broadly in the device, wherein the second and/or third automatic feed unit 16, 18 are driven synchronously or substantially synchronously with the first automatic feed unit 17, although with an advance speed which is different from that of the first automatic feed unit.

A further feature or aspect of an embodiment is believed at the time of the filing of this patent application to possibly reside broadly in the device, wherein the looper 8 is realized for the formation of an approximately mass-less loop of the labeling material 4.

Another feature or aspect of an embodiment is believed at the time of the filing of this patent application to possibly reside broadly in the device, wherein the labeling material 4 and/or the backing material 4.1 are each moved with some slip by the second and/or third automatic feed unit 16, 18.

Yet another feature or aspect of an embodiment is believed at the time of the filing of this patent application to possibly reside broadly in the device, wherein the first and/or second and/or third automatic feed unit each have at least two rolls or rollers 16.1, 17.1, 18.1; 16.2, 17.2, 18.2 which form a gap between them for the passage of the labeling and/or backing material 4, 4.1 and in which at least one roll or roller 16.1, 17.1, 18.1 is driven in rotation by a drive.

Still another feature or aspect of an embodiment is believed at the time of the filing of this patent application to possibly reside broadly in the device, wherein the second and/or third automatic feed unit 16, 18 has a controllable drive, by means of which the advance or transport speed of these advance feeds can be regulated or controlled as a function of the strip tension.

A further feature or aspect of an embodiment is believed at the time of the filing of this patent application to possibly reside broadly in the device, comprising sensors 19 for the measurement of the strip tension.

Another feature or aspect of an embodiment is believed at the time of the filing of this patent application to possibly reside broadly in the device, wherein the second automatic feed unit 16 is provided immediately or substantially immediately at the outlet of the looper 8 or at the outlet of a loop well 8.1 of this looper 8.

Yet another feature or aspect of an embodiment is believed at the time of the filing of this patent application to possibly reside broadly in the device, wherein the drive mechanism for the automatic feed units 15, 16, 17, 18 for the movement of the labeling material 4 and/or of the backing material 4.1 can be reversed for an advance or transport direction that is opposite to the normal advance or transport direction.

The components disclosed in the various publications, disclosed or incorporated by reference herein, may possibly be used in possible embodiments of the present invention, as well as equivalents thereof.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

The appended drawings in their entirety, including all dimensions, proportions and/or shapes in at least one embodiment of the invention, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

All, or substantially all, of the components and methods of the various embodiments may be used with at least one embodiment or all of the embodiments, if more than one embodiment is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

All of the patents, patent applications and publications recited herein, and in the Declaration attached hereto, are hereby incorporated by reference as if set forth in their entirety herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

All of the patents, patent applications or patent publications, which were cited in the International Search Report dated Aug. 21, 2007, and/or cited elsewhere are hereby incorporated by reference as if set forth in their entirety herein as follows: DE 195 22 295, having the English translation of the German title "METHOD OF REGULATING LABELLING TAPE TENSION IN LABELLING MACHINE," published on Jan. 2, 1997; U.S. Pat. No. 4,366,023, having the title "MECHANISM FOR APPLYING LABELS AND THE LIKE," published on Dec. 28, 1982; FR 2,737,185, having the French title "ETIQUETEUSE COMPACTE MODULAIRE ASSURANT UN MEILLEUR CONTROLE DE LA TENSION DE LA BANDE D'ETIQUETTES," published on Jan. 31, 1997; U.S. Pat. No. 5,248,355, having the title "APPARATUS FOR APPLYING HEAT SENSITIVE LABELS AND PRESSURE SENSITIVE LABELS," published on Sep. 28, 1993; DE 40 02 194, having the English translation of the German title space "BAND CONNECTOR FOR RELEASABLE LABEL SUPPORTS—HAS COUPLING STATION FOR TWO BANDS, AND BUFFER STATION IN FRONT OF LABEL RELEASE EDGE," published on Aug. 1, 1991; DE 20 2005 005713, having the English translation of the German title "LOOPING CHAMBER FOR BUFFERING LABELS APPLIED TO CONTAINERS SUCH AS BOTTLES OR CANS, HAS BELT-LIKE MEMBER WOUND AROUND TAKE-UP ROLLER," published on Jun. 16, 2005; DE 37 02 595, having the English translation of the German title "METHOD OF CHARGING A LABELLING MACHINE AND LABEL STORAGE ARRANGEMENT," published on Aug. 18, 1988; and U.S. Pat. No. 4,276,112, having the title "INDIVIDUALIZED LABEL APPLICATION SYSTEM," published on Jun. 30, 1981.

The purpose of incorporating U.S. patents, Foreign patents, publications, etc. is solely to provide additional information relating to technical features of one or more embodiments, which information may not be completely disclosed in the wording in the pages of this application. Words relating to the opinions and judgments of the author and not directly relating to the technical details of the description of the embodiments therein are not incorporated by reference. The words all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned words in this sentence, when not used to describe technical features of one or more embodiments, are not considered to be incorporated by reference herein.

Some examples of labeling materials, which may possibly be utilized or possibly adapted for use in at least one possible embodiment of the present application may possibly be found in the following U.S. patents: U.S. Pat. No. 4,061,808, having the title "COMPOSITE LABEL STRIP FOR USE LABEL APPLYING APPARATUS," published on Dec. 6, 1977; U.S. Pat. No. 4,210,688, having the title "PRESSURE SENSITIVE LABELS STRIP FOR USE IN A LABEL PRINTING MACHINE," published on Jul. 1, 1980; U.S. Pat. No. 4,642,256, having the title "LABEL STRIP," published on Feb. 10, 1987; and U.S. Pat. No. 4,335,172, having the title "PRESSURE SENSITIVE LABEL STRIP," published Jun. 15, 1982.

The purpose of incorporating U.S. patents, Foreign patents, publications, etc. is solely to provide additional information relating to technical features of one or more embodiments, which information may not be completely disclosed in the wording in the pages of this application. Words relating to the opinions and judgments of the author and not directly relating to the technical details of the description of the embodiments therein are not incorporated by reference. The words all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned words in this sentence, when not used to describe technical features of one or more embodiments, are not considered to be incorporated by reference herein.

Some examples of rollers for use in labeling machines, which may possibly be utilized or possibly adapted for use in at least one possible embodiment of the present application may possibly be found in the following U.S. patents: U.S. Pat. No. 5,427,460, having the title "LABEL PRINTER AND LABEL STRIPPER FEED MECHANISM THEREFORE," published Jun. 27, 1995; U.S. Pat. No. 4,257,327, having the title "LABEL STRIP INSERTING DEVICE," published on Mar. 24, 1981; U.S. Pat. No. 7,404,275, having the title "LABELING MACHINE FOR BEVERAGE BOTTLING PLANT," published on Jul. 29, 2008; and U.S. Pat. No. 6,634,400, having the title "LABELING MACHINE," published on Oct. 21, 2003.

The purpose of incorporating U.S. patents, Foreign patents, publications, etc. is solely to provide additional information relating to technical features of one or more embodiments, which information may not be completely disclosed in the wording in the pages of this application. Words relating to the opinions and judgments of the author and not directly relating to the technical details of the description of the embodiments therein are not incorporated by reference. The words all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned words in this sentence, when not used to describe technical features of one or more embodiments, are not considered to be incorporated by reference herein.

Some examples of labeling machines for the use of applying wraparound labels to bottles, which may possibly be utilized or possibly adapted for use in at least one possible embodiment of the present application may possibly be found in the following U.S. patents and patent applications: U.S. Pat. No. 3,984,277, having the title "LABEL APPLICATOR," published on Oct. 5, 1976; U.S. Pat. No. 4,115,179, having the title "WRAP NECK LABEL MECHANISM," published on Sep. 19, 1978; U.S. Pat. No. 4,662,965, having the title "ADHERING HEAT SENSITIVE LABELS TO CONTAINERS WITH HOT MELT ADHESIVES," published on May 5, 1987; U.S. Pat. No. 4,729,811, having the title "INFEED GUIDE AND ROLL-ON BELT FOR BOTTLE LABELING MACHINE," published Mar. 8, 1988; and patent application Ser. No. 12/235,668, having the title "LABELING MACHINE, A VACUUM DRUM FOR USE IN A LABELING MACHINE, AND A METHOD OF USING A LABELING MACHINE HAVING A VACUUM DRUM," filed on Sep. 23, 2008.

The purpose of incorporating U.S. patents, Foreign patents, publications, etc. is solely to provide additional information relating to technical features of one or more embodiments, which information may not be completely disclosed in the wording in the pages of this application. Words relating to the opinions and judgments of the author and not directly relating to the technical details of the description of the embodiments therein are not incorporated by reference. The words all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned words in this sentence, when not used to describe technical features of one or more embodiments, are not considered to be incorporated by reference herein.

Some examples of tension sensors, which may possibly be utilized or possibly adapted for use in at least one possible embodiment of the present application may possibly be found in the following U.S. patents: U.S. Pat. No. 5,878,933, having the title "STRIP GUIDING APPARATUS AND ASSOCIATED METHOD FOR MAINTAINING LATERAL POSITION," published Mar. 9, 1999; U.S. Pat. No. 6,481,275, having the title "METHOD AND APPARATUS FOR MEASURING THE TENSION OF A MOVING WEB," published on Nov. 19, 2002; U.S. Pat. No. 6,769,297, having the title "METHOD AND EQUIPMENT FOR MEASURING TENSION OF MOVING WEB," published on Aug. 3, 2004; U.S. Pat. No. 6,813,941, having the title "METHOD TO MEASURE TENSION AND A MOVING WEB AND TO CONTROL PROPERTIES OF THE WEB," published Nov. 9, 2004; and U.S. Pat. No. 7,392,960, having the title "METHOD FOR UNWINDING ROLLS OF WEB MATERIAL," published Jul. 1, 2008.

The purpose of incorporating U.S. patents, Foreign patents, publications, etc. is solely to provide additional information relating to technical features of one or more embodiments, which information may not be completely disclosed in the wording in the pages of this application. Words relating to the opinions and judgments of the author and not directly relating to the technical details of the description of the embodiments therein are not incorporated by reference. The words all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned words in this sentence, when not used to describe technical features of one or more embodiments, are not considered to be incorporated by reference herein.

The corresponding foreign and international patent publication applications, namely, Federal Republic of Germany Patent Application No. 10 2006 019 265.6, filed on Apr. 26, 2006, having inventors Holger STENNER and Frank PUTZER, and DE-OS 10 2006 019 265.6 and DE-PS 10 2006 019 265.6, and International Application No. PCT/EP2007/002754, filed on Mar. 28, 2007, having WIPO Publication No. WO2007/124821 and inventors Holger STENNER and Frank PUTZER, are hereby incorporated by reference as if set forth in their entirety herein for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

The purpose of incorporating the Foreign equivalent patent application PCT/EP2007/002754 and German Patent Application 10 2006 019 265.6 solely for the purpose of providing a basis of correction of any wording in the pages of the present application, which may have been mistranslated or misinterpreted by the translator. Words relating to opinions and judgments of the author and not directly relating to the technical details of the description of the embodiments therein are not to be incorporated by reference. The words all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned word in this sentence, when not used to describe technical features of one or more embodiments, are not generally considered to be incorporated by reference herein.

Statements made in the original foreign patent applications PCT/EP2007/002754 and DE 10 2006 019 265.6 from which this patent application claims priority which do not have to do with the correction of the translation in this patent application are not to be included in this patent application in the incorporation by reference.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72 (b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

AT LEAST PARTIAL NOMENCLATURE

1 Labeling unit
2 Support
3 Receptacle or winding mandrel
4 Labeling material
4.1 Backing material
4.2 Label
5 Supply roll
6 Receptacle or winding mandrel
7 Empty coil
8 Looper
9 Dispensing edge
10 Object to be labeled
11 Deflector pulley
12 Guide
13, 14 Buffer rollers
15, 16, 17, 18 Automatic feed unit
15.1, 16.1, 17.1, 18.1 Driven roll or roller of the automatic feed unit
15.2, 16.2, 17.2, 18.2 Counter roller
19 Sensor for the measurement of the strip tension

What is claimed is:

1. A labeling arrangement comprising:
a self-adhesive labeling material supply arrangement;
a looper being configured to receive labeling material from said supply arrangement;
a first drive unit being configured to pull labeling material from said looper;
a dispensing edge being configured to separate labels from backing material of labeling material;
a second drive unit being configured to pull labeling material from said first drive unit and past said dispensing edge;
a third drive unit being configured to pull label-free backing material from said second drive unit;
a receptacle being configured to receive label-free backing material; and
a control system being configured to control said drive units individually and at different speeds, wherein said control system is further configured to operate the second drive unit at a speed greater than the first drive unit and the third drive unit at a speed greater than the second drive unit, and thus control the tension force on each section of the labeling material generated by said drive units.

2. The labeling arrangement according to claim 1, wherein said second drive unit is configured to operate at a speed greater than said first drive unit to maintain a constant or essentially constant tension on the section of labeling material therebetween.

3. The labeling arrangement according to claim 2, wherein said third drive unit is configured to operate at a speed greater than said second drive unit to maintain a constant or essentially constant tension on the section of label-free backing material therebetween.

4. The labeling arrangement according to claim 3, wherein said second drive unit is configured to perform a clocked advance of the label material.

5. The labeling arrangement according to claim 4, wherein at least one of said first and third drive units is configured to be operated in coordination with said second drive unit, though at different operating speeds.

6. The labeling arrangement according to claim 5, wherein said looper is configured to suspend a loop of labeling material therein with a flow of gas.

7. The labeling arrangement according to claim 6, wherein said first and third drive units are configured to pull labeling material with slip.

8. The labeling arrangement according to claim 7, wherein each of said drive units comprises a drive and at least two rollers, between which labeling material is fed, and wherein at least one of said rollers is driven in rotation by its drive.

9. The labeling arrangement according to claim 8, wherein said drives of said first and third drive units are adjustable speed drives configured to be adjusted to adjust and control the operational speed thereof to control the strip tension generated thereby.

10. The labeling arrangement according to claim 9, wherein said labeling arrangement further comprises a sensor arrangement configured to measure the strip tension of at least one section of the labeling material.

11. The labeling arrangement according to claim 10, wherein said first drive unit is disposed immediately adjacent an outlet of said looper.

12. The labeling arrangement according to claim 11, wherein said drive units are configured to pull labeling material in a transport direction, and configured to be reversed to pull labeling material opposite the transport direction.

13. The labeling arrangement according to claim 12, wherein:
said first drive unit and said second drive unit together generate a tension force on the section of labeling material therebetween; and
said second drive unit and said third drive unit together generate a tension force on the section of the label-free backing material therebetween.

14. The labeling arrangement according to claim 13, wherein:
said first drive unit is configured to provide a pulling force sufficiently high to provide resistance to the pulling force of said second drive unit to generate a tension force sufficient to minimize flapping or flutter of labeling material between said first drive unit and said second drive unit yet sufficiently low to minimize damage or tearing of the labeling material; and said second drive unit is configured to provide a pulling force sufficiently high to provide resistance to the pulling force of said third drive unit to generate a tension force sufficient to minimize flapping or flutter of labeling material between said second drive unit and said third drive unit yet sufficiently low to minimize damage or tearing of the backing material.

15. The labeling arrangement according to claim 14, wherein said labeling arrangement is configured to handle labeling material having a thickness of about 15 micrometers.

16. The labeling arrangement according to claim 1, wherein:

said first drive unit and said second drive unit together generate a tension force on the section of labeling material therebetween; and said second drive unit and said third drive unit together generate a tension force on the section of the label-free backing material therebetween.

17. The labeling arrangement according to claim 1, wherein:

said first drive unit is configured to provide a pulling force sufficiently high to provide resistance to the pulling force of said second drive unit to generate a tension force sufficient to minimize flapping or flutter of labeling material between said first drive unit and said second drive unit yet sufficiently low to minimize damage or tearing of the labeling material; and said second drive unit is configured to provide a pulling force sufficiently high to provide resistance to the pulling force of said third drive unit to generate a tension force sufficient to minimize flapping or flutter of labeling material between said second drive unit and said third drive unit yet sufficiently low to minimize damage or tearing of the backing material.

18. The labeling arrangement according to claim 1, wherein said labeling arrangement is configured to handle labeling material having a thickness of about 15 micrometers.

* * * * *